US007147914B2

(12) United States Patent
Kim et al.

(10) Patent No.: US 7,147,914 B2
(45) Date of Patent: Dec. 12, 2006

(54) FULL DULL POLYAMIDE 6 YARN, AND A PROCESS OF PREPARING FOR THE SAME

(75) Inventors: Jae-Young Kim, Gumi (KR); Young-Tae Park, Gumi (KR)

(73) Assignee: Kolon Industries, Inc, Kyunggi-do (KR)

( * ) Notice: Subject to any disclaimer, the term of this patent is extended or adjusted under 35 U.S.C. 154(b) by 0 days.

(21) Appl. No.: 10/535,204

(22) PCT Filed: Nov. 21, 2003

(86) PCT No.: PCT/KR03/02523

§ 371 (c)(1),
(2), (4) Date: May 17, 2005

(87) PCT Pub. No.: WO2004/048652

PCT Pub. Date: Jun. 10, 2004

(65) Prior Publication Data

US 2006/0046052 A1 Mar. 2, 2006

(30) Foreign Application Priority Data

Nov. 22, 2002 (KR) ..... 10-2002-0072977

(51) Int. Cl.
*D01F 6/00* (2006.01)

(52) U.S. Cl. ..... 428/364; 428/372; 428/395

(58) Field of Classification Search ..... 428/364, 428/372, 395
See application file for complete search history.

(56) References Cited

U.S. PATENT DOCUMENTS 2,985,621 A * 5/1961 Gewehr et al. ..... 524/413
3,533,984 A * 10/1970 Hanawa et al. ..... 524/707
3,556,720 A * 1/1971 Cox et al. ..... 423/85
4,460,649 A * 7/1984 Park et al. ..... 428/373
4,742,008 A * 5/1988 Nissen et al. ..... 435/200

FOREIGN PATENT DOCUMENTS

| | | | |
|---|---|---|---|
| JP | 54-151620 | A | 11/1979 |
| JP | 60-112849 | A | 6/1985 |
| KR | 1996-84 | A | 1/1996 |
| KR | 1996-22661 | A | 7/1996 |

* cited by examiner

*Primary Examiner*—N. Edwards
(74) *Attorney, Agent, or Firm*—Birch, Stewart, Kolasch & Birch, LLP

(57) ABSTRACT

The present invention relates to a full dull polyamide 6 yarn and a process for preparing the same. The yarn of this invention contains 1.5 to 2.5% by weight of titanium dioxide relative to the weight of the yarn, has 35 to 95 titanium dioxide particles having a major axial length of greater than 5 μm being contained in 50 mg of the yarn, and contains 0.1 to 0.5% by weight of phosphate salt (wetting agent) relative to the weight of titanium dioxide. In the process of this invention, 0.1 to 0.5% by weight of phosphate salt relative to the weight of titanium dioxide is added as a wetting agent, carprolactam is applied along with water upon concentration correction, and naphthalene sulfonate based salt is applied along with titanium dioxide slurry during the process of polyamide 6 polymerization. The present invention improves the full dull effect and drape property of the yarn since it contains a great quantity of titanium dioxide having a proper diameter in the yarn without degrading the yarn physical properties and operationability.

1 Claim, No Drawings

FULL DULL POLYAMIDE 6 YARN, AND A PROCESS OF PREPARING FOR THE SAME

TECHNICAL FIELD

The present invention relates to a full dull polyamide 6 yarn which is full dull and has an excellent weightiness (hereinafter refer to as "drape property") since it contains a great quantity of titanium dioxide within the yarn, and a process for preparing the same.

Polyamide 6 yarns are being widely used for clothing as a substitute for natural yarns due to its excellent mechanical properties, and the like. But, there is a problem in that they exhibit a cold feeling and an excessively lightweight feeling due to its metallic brilliance. Also, they are too transparent, and as such they cannot satisfy the market demand.

BACKGROUND ART

To solve the above problem, there is being widely used the process of eliminating brilliance and improving the drape property by applying an inorganic material exhibiting a dulling effect during the process of polymerizing the polyamide 6 yarn. But, this process is problematic in that, when the input of the inorganic material is set high to 1.5% by weight relative to the weight of the yarn (polymer), the operational ability becomes degraded and the yarn physical properties are deteriorated due to the nonuniform dispersion of the inorganic material.

Therefore, in the prior art, there is a limitation that an inorganic material of greater than 1.5% by weight cannot be contained in a polyamide 6 yarn, and accordingly, there is a limit in attempting to eliminate the metallic brilliance of the yarn or enhance the drape property.

The process of prior art in applying an inorganic material in a yarn, will be described in more detail. A slurry of inorganic material is prepared through a process of wetting an inorganic material with water, a process of grinding the inorganic material condensed in the above process, a concentration correction process, and a sedimentation process. Next, the slurry is applied during the polymerization process of polyamide 6 to produce a full dull polyamide 6 yarn. The inorganic material, mainly used is titanium dioxide having an average diameter of 0.3 to 0.4 μm.

In the above process, the degradation of the operational ability and yarn physical properties does not only occur due to the original particle size of the titanium dioxide, but also occurs because the titanium dioxide is rapidly condensed during the wetting process.

In the above process of the prior art, the condensation of titanium dioxide in the wetting process is unavoidable. The problem of titanium dioxide condensation in the wetting process is overcome by a process in which large particles of titanium dioxide are separated before titanium dioxide is applied in the polymerization process of polyamide 6, and thus only small particles are utilized.

Due to this, the yield of the titanium dioxide slurry production process is degraded, the process becomes complicated because the separation process is added, and the particle size of titanium dioxide applied in the polymerization process is nonuniform.

Therefore, in the process of prior art, in a case where titanium dioxide of more than 1.5% by weight, relative to the weight of a yarn (polymer) is applied, there occurs a problem that the pressure of a pack (spinneret) rapidly increases due to large diameter particles of titanium dioxide, and the yarn tension becomes nonuniform due to a nonuniform dispersion of titanium dioxide, thereby making the bending and cutting of yarns disposed directly below the spinneret more serious.

In the prior art, the input of titanium dioxide cannot be set to more than a predetermined level due to the degradation of the operational ability and physical properties, and accordingly the full dull property and drape property of polyamide 6 yarn is difficult to achieve.

Korean Laid-Open Patent No. 1999-60536 discloses a process for preparing a polyamide yarn by a high speed spinning, which produces a polyamide ultrafine yarn having a monofilament fineness of below 1.0 denier by adding titanium dioxide in the step of polyamide polymerization, wherein the portions directly below the spinneret are maintained at a heating atmosphere.

Although the detailed description of the above prior patent describes that titanium dioxide of 1 to 3% by weight is added in the polyamide polymerization step, every examples of the prior patent describes that titanium dioxide of 1.5% by weight is added in the polyamide polymerization step.

This is because, as described above, in a case that titanium dioxide of more than 1.5% by weight is added in the polyamide polymerization step, there occurs a problem that the operational ability is degraded and the yarn physical properties are deteriorated due to a nonuniform dispersion of titanium dioxide.

Moreover, the above prior patent does not suggests concrete means, for example, preparation conditions of the slurry of titanium dioxide, for overcoming the above problems which occur when applying titanium dioxide of more than 1.5% by weight in the polyamide polymerization step.

Subsequently, also in the Korean Laid-Open Patent No. 1999-60536, in the case where the amount of titanium dioxide is over 1.5% by weight, it is inevitable that a degradation of the operational ability and yarn physical properties will occur due to a nonuniform dispersion of the titanium dioxide.

As a prior art for improving the dispersability of titanium dioxide in polyamide, Korean Laid-Open Patent No. 2003-0012336 discloses a process of applying 0.05 to 0.2 parts by weight of an amine based material relative to a caprolactam monomer while using an existing viscosity stabilizer, i.e., acetic acid.

However, the above prior art has the drawback that it is difficult to prevent recondensation since a contact between acetic acid and titanium dioxide is possible, though the prior art may be effective to prevent the recondensation of titanium dioxide with an increase in repulsive force between titanium dioxide particle surfaces by pH control in the polymerization process. Further, since polymerization is typically carried out at a high temperature of higher than 250° C., in case of an amine based compound, there may occur a problem that its effect is not realized because the polymerization conditions such as a burning point, viscosity, etc. are not satisfied if the number of carbon atoms is below 10.

Additionally, since acid and amines are used in combination, the activity of polymerization may differ according to the input equivalent ratio. This may be a factor in generating a difference in molecular weight of the final polymer or a difference in the terminal groups.

As another prior art, Korean Laid-Open Patent NO. 2003-0034845 discloses a process of applying 0.05 to 0.2 parts by weight of an aromatic amine relative to caprolactam without using acetic acid.

The above process maintains a good dispersability of titanium dioxide in the polymerization process, but a reduction of the zeta potential occurs at some portions in a reactor due to the abundance of the amine, to thereby cause a deterioration in the dispesability of titanium dioxide. In addition, the breadth of change in relative viscosity (RV) before and after melting increases due to an increase in the terminal amine groups, and therefore it is difficult to control the strength of a final product. And, the above process is known to those skilled in the art as a process generally performed mainly for the purpose of improving deep color-dyeing or improving color difference. To complement the physical properties problem, the process of minimizing the breadth of change in relative viscosity (RV) before and after deep color-dyeing and melting by using an amine having no reactivity and being utilizable as a dyeing site is widely used.

Further, the above-described prior art process all aim only at maintaining the dispersability of titanium dioxide in the polymerization process at a slurry level without mentioning detailed techniques for the production of the titanium dioxide slurry. Accordingly, it is important to economically and efficiently produce a slurry of titanium dioxide with a good dispersability.

In addition, in case of generally using a low molecular amine based compound, there is the possibility that polymerization may be accelerated by the reactivity of the amine, and thus the color of the final polymer becomes poor.

Accordingly, it is an object of the present invention to provide a process for allowing a relatively large quantity of titanium dioxide to be contained in a yarn without degrading the operational ability and physical properties of the yarn by dispersing titanium dioxide uniformly in the polymer by preventing the recondensation of titanium dioxide in the wetting process.

It is another object of the present invention to provide a polyamide 6 yarn which is full dull and has a good drape property because it contains a large quantity of titanium dioxide.

DISCLOSURE OF THE INVENTION

The present invention provides a process for adding a large quantity of titanium dioxide in a yarn (polymer) without degrading the operational ability and the physical properties of yarns by minimizing the diameter of the titanium dioxide to be applied in the step of polyamide 6 polymerization and dispersing the applied titanium dioxide uniformly.

In addition, the present invention provides a polyamide 6 yarn which is full dull and has an excellent drape property because a large quantity of titanium dioxide having a proper diameter is uniformly contained in the yarn.

To achieve the above objects, the present invention provides a full dull polyamide 6 yarn, which contains 1.5 to 2.5% by weight of titanium dioxide relative to the weight of the yarn, which has 35 to 95 titanium dioxide particles having a major axial length of greater than 5 μm being contained in 50 mg of the yarn, and which contains 0.1 to 0.5% by weight of phosphate salt (wetting agent) relative to the weight of titanium dioxide.

Additionally, the present invention provides a process for preparing a full dull polyamide 6 yarn, in which the full dull polyamide 6 yarn is produced by preparing a titanium dioxide slurry through wetting, grinding, concentration correcting, sedimentation and storage processes and applying the same during the process of polyamide 6 polymerization, wherein 0.1 to 0.5% by weight of phosphate salt relative to the weight of titanium dioxide is added as a wetting agent, carprolactam is applied along with water upon concentration correction, and naphthalene sulfonate based salt is applied along with titanium dioxide slurry during the process of polyamide 6 polymerization.

Hereinafter, the present invention will be described in detail.

Firstly, titanium dioxide slurry is prepared through wetting, grinding, concentration correction, sedimentation and storage processes. In the wetting process, a titanium dioxide powder is wet with water, a dispersion medium, in the ratio of 50:50. Then, 0.1 to 0.5% by weight of phosphate salt, such as sodium biphosphate, is added as a wetting agent relative to the weight of titanium dioxide, and stirred.

A typical polyamide 6 polymerization is carried out in such a step that a predetermined amount of water is put into caprolactam, a major material, then a ring-opening reaction is performed, and then polycondensation is performed, thereby making a final polymer. Thus, the reaction is conducted with a predetermined amount of water being contained within the reaction system. Hence, in the production process of the titanium dioxide slurry, water is utilized as a dispersion media for wetting titanium dioxide of a powdery state to turn it into a liquid state under economical conditions.

The wetting agent is applied in order to reduce the cycle of the wetting process by increasing the affinity between water and titanium dioxide and minimizing the particle size as much as possible right after the wetting process.

The wetting agent is such a material in which an ionic bond and a covalent bond coexist. It firstly increases the affinity between water and titanium dioxide through an electrical charge, and, further, serves to control the electrical attractive force related to the condensation in a subsequent process of titanium dioxide slurry production.

In the case of applying the wetting agent below 0.1% by weight relative to the weight of titanium dioxide, the above-mentioned effect is rarely exhibited. In the case of applying the wetting agent of over 0.5% by weight, the extent of increase of affinity becomes smaller as compared to when the wetting agent of 0.5% by weight is applied, thus the production cost is increased. In case of applying an extremely large amount, this may cause adverse effects from a condensation viewpoint.

But, this does not mean that final titanium dioxide slurry is completed in the wetting process. The primary objective of the wetting process is to wet titanium dioxide of a powdery state with water, i.e., a dispersion medium most efficiently, and, in addition, to provide the foundation enabling a good dispersion in the subsequent titanium dioxide slurry production process.

In a case that the average particle diameter of titanium dioxide powder is 0.3 to 0.4 μm, after the wetting process of the present invention, the average particle diameter of titanium dioxide becomes about 0.6 μm.

To solve the problem of physical condensation of titanium dioxide occurring in the wetting process, it is preferred that stirring is performed for one hour at a low speed and for one hour at a high speed. The stirring speed is set to a proper level in conjunction with the geometric structure of a stirring tank. In case of stirring at a high speed from an initial stage, wetting efficiency may be lowered due to an excessive heat generated in the stirring. Thus, it is preferred that the stirring is performed at a low speed at an initial stage, and, after a predetermined time, performed at a high speed.

After the wetting process, the titanium dioxide slurry made in the wetting process is made finer and uniformly dispersed through a grinding process. Preferably, the grinding process is performed repetitively about two times using a sand grinder filled with about 20% by weight of zirconium fill. However, the present invention does not specifically limit the grinding process.

Preferably, upon grinding, the flow rate of titanium dioxide slurry is maintained at 5 to 20 kg/min, and the temperature of titanium dioxide grinded is maintained at 35 to 50° C.

After the grinding process, the concentration of titanium dioxide is corrected so that the grinded titanium dioxide slurry can have such a concentration capable of allowing the titanium dioxide slurry to have the most stabilized state.

Most preferably, the concentration is corrected with water, i.e., a dispersion medium. But, in case of correcting the concentration by increasing in weight of water, the dispersion stability of the titanium dioxide slurry is reduced because the apparent viscosity of the titanium dioxide slurry is lowered, whereby titanium dioxide particles may be recondensed.

In addition, the amount of water is increased in the subsequent polymerization process to cause an excessive ring-opening reaction and, further, cause the problem of a decrease in polymerization speed. For this reason, the present invention is characterized in that, upon a concentration correction, caprolactam, which is a main material, is mixed with water at a predetermined ratio.

The amount of caprolactam to be applied is preferably 25 to 35% by weight relative to the total quantity of titanium dioxide slurry. The reason thereof is that, since the final titanium dioxide slurry is made through sedimentation for four days after the step of concentration correction, the sorting efficiency of titanium dioxide through sedimentation is more increased if the amount of caprolactam is more decreased from a sedimentation viewpoint.

And, as the amount of caprolactam is increased, the dielectric constant of the slurry is lowered to thus increase condensation. From this viewpoint, the smaller the amount of caprolactam, the better. Immediately after the concentration correction, simple sedimentation is carried out in a concentration correction tank for one day to thus reduce final sedimentation load.

Next, sedimentation is performed to the titanium dioxide slurry compensation-corrected and simply sedimented as above. In the sedimentation process, the final titanium dioxide slurry with a minimized average diameter is achieved through an extended sedimentation period of four days.

The sedimentation velocity (or settling velocity) in the sedimentation tank is inversely proportional to the viscosity of a dispersion medium and the height of the sedimentation tank, and proportional to the temperature of the dispersion medium, the acceleration of gravity, the density of titanium dioxide and the like. Of them, the adjustable variables in the process are the height of the sedimentation tank, the temperature of the dispersion medium and so on, and the proper conditions for these variables are selected as follows.

It is measured whether the average particle size of final titanium dioxide slurry sorted through sedimentation in the sedimentation tank for four days is consistent with a required level, and then the above variables are adjusted according to the result of the measurement.

In the present invention, according to the result of measurement by a particle size analyzer, the average particle size of titanium dioxide in the final titanium dioxide slurry is 0.38 μm. The particle concentration of titanium dioxide in the titanium dioxide slurry is 18.5 to 22.0% by weight upon measuring by a standard gravimeter at 20° C.

Next, the sorted titanium dioxide slurry is stored. In the above storage process, it is important to reduce the detention time as much as possible since the slurry is stored right before being applied to the process. To prevent settlement during detention, it is preferable to maintain the temperature low.

The titanium dioxide slurry made as above has an excellent dispersability, so it is possible to apply a greater content thereof than that applied in the prior art.

Next, the thusly made titanium dioxide slurry is supplied to a polyamide 6 polymerization system to thus produce a full dull polyamide 6 yarn. At this time, the present invention is characterized in that a naphthalene sulfonate based salt is applied together as a dispersion agent.

In other words, when the titanium dioxide slurry is applied in the polymerization, condensation may again occur. Thus, in the present invention, the recondensation of titanium dioxide particles in the polyamide polymerization process is controlled by adjusting the electrical potential with the applied naphthalene sulfonate based salt. The amount of the dispersion agent applied in the present invention is preferably 30 to 60 cc relative to 1 kg of titanium dioxide particles.

The thusly produced polyamide 6 yarn (polymer) of the present invention is excellent in the dispersability of titanium dioxide particles, and is excellent in producing a full dull property and drape property since a large quantity of titanium dioxide, that is, 1.5 to 2.5% by weight, is contained in the yarn, relative to the weight of the yarn. In addition, the polyamide 6 yarn (polymer) of the present invention has 35 to 95 particles of titanium dioxide having a major axial length of greater than 5 μm in 50 mg of the yarn (polymer).

Additionally, the polyamide 6 yarn (polymer) of the present invention contains 0.1 to 0.5% by weight of phosphate salt (wetting agent) relative to the weight of titanium dioxide.

The operation ability of preparing the yarn of the present invention is good, which is the same level as the operation ability of the prior art production process of a polyamide 6 yarn containing 0.3 to 0.4% by weight of titanium dioxide.

Various physical properties of the yarn (polymer) in the present invention are evaluated as follows.

Number of Coarse Particles

The number of coarse particles means the number of condensed titanium dioxide particles having a major axial length of greater than 5 μm contained in 50 mg of a polyamide 6 yarn (polymer). A sheet of slide glass is placed on a hot plate of 250° C., a sheet of glass film is placed thereon, 50 mg of the yarn (polymer) is placed and melted thereon, and then a sheet of cover glass is covered thereon. Next, the yarn is pressed by 200 g of a weight to be thinly stretched, and then the entire regions of the sample are scanned by a light microscope of total 200 magnifications, thereby measuring the number of condensed titanium dioxide particles having a size of greater than 5 μm.

Besides the above-mentioned hot plate process, among the sample preparation process for measuring the number of condensed titanium dioxide particles, there is the process of using a small-sized extruder with a T-shaped spinneret. In this process, an undrawn film is prepared by a small-sized extruder, cooled by a casting drum, and then cut to a size proper to a drawing machine. The cut undrawn film is simultaneously biaxially oriented, and then heat-treated to prepare a sample for measurement. At this time, the temperature of the small-sized extruder is about 260 to 280° C., and the casting drum after the spinneret is maintained at 10° C., thereby to produce an undrawn film. The undrawn film is simultaneously biaxially oriented three times transversely and longitudinally each at about 55° C., and then thermoset for 30 seconds at about 200° C., thereby to produce a final measurement sample.

Content of Wetting Agent

A polyamide 6 yarn is pre-treated by the wet oxidation process and the oxidizer application and decomposition process, and then the content of a wetting agent is measured by an inductively coupled plasma mass analyzer (a product of VG ELEMENTAL, model name: Plasma Quad3).

Dispersability of Titanium Dioxide

A specimen made by slicing a polyamide 6 yarn (polymer) by a cutter of Microtom is immersed on a sheet of slide glass with paraffin, a sheet of cover glass is covered thereon, and projection photographs of 10 areas are taken by a light microscope of 625 magnifications. Condensed titanium dioxide particles are found from each of the photographs, and the size and number thereof are arranged. Among 10 results arranged, the dispersability of titanium dioxide is judged according to the remaining 8 results, except for the best result and the worst result. Of the 8 results, if more than 7 results are excellent, it is represented as ◎, if 5 to 6 results are excellent, it is represented as O, and if less than 4 results are excellent, it is represented as Δ.

Operationability (Full Drum Rate—F/D Rate)

The operationability is indicated by the F/D rate showing the ratio of the number of full drums that are fully wound per the total number of drums manufactured in a spinning process.

$$\text{Operationability}\,(F/D\ \text{rate}) = \frac{\text{number of full drums}}{\text{total number of drums}} \times 100(\%)$$

Full Dull Property

Yarns are tube-knitted and then evaluated by an organoleptic test by panelists. Of five panelists with over seven year's career, if more than four people agree that the full dull property is excellent, it is indicated as ◎, if two or three people agree that the full dull property is excellent, it is indicated as O, and less than one people agrees that the full dull property is excellent, it is indicated as Δ.

Drape Property

A cloth made by tube-knitting yarns is cut to a circular shape having a 25 cm diameter, then placed over a cylinder having a 12.5 cm diameter, and then evaluated in drape property according to how long the cloth is draped down (drape coefficient: F). If the drape coefficient (F) is less than 0.3, it is indicated as ◎, and if the drape coefficient (F) is more than 0.3, it is indicated as Δ. The drape coefficient is calculated by the following formula:

$$\text{Drape Coefficient}\,(F) = \frac{r^2 - rd^2}{rD^2 - rd^2}$$

Wherein rD represents the radius of a completely hard twist fabric, rd represents the radius of a completely soft twist fabric, and r represents the radius of a specimen.

BEST MODE FOR CARRYING OUT THE INVENTION

The present invention is now understood more concretely by comparison between examples of the present invention and comparative examples. However, the present invention is not limited to such examples.

EXAMPLE 1

Titanium dioxide with an average diameter of 0.3 μm is wet with water in the ratio of 50:50, then added with 0.3% by weight of sodium biphosphate (wetting agent) relative to the weight of titanium dioxide and stirred, and then grinded with a sand grinder.

Next, the concentration of titanium dioxide slurry is corrected by using water and 30% by weight of caprolactam relative to the weight of titanium dioxide slurry, and then the titanium dioxide slurry is immersed for four days, thereby to prepare final titanium dioxide slurry.

Next, the titanium dioxide slurry is applied in a polyamide 6 polymerization process along with sodium naphthalene sulfonate (dispersion agent) in a 20% aqueous solution state to thus produce a polyamide 6 polymer. The polyamide 6 polymer is composed of 100% by weight of caprolactam, 5.3 parts by weight of water and 0.1 parts by weight of acetic acid.

Here, the titanium dioxide slurry is applied in such a composition in which the quantity of titanium dioxide particles can be 1.8 parts by weight relative to 100 parts by weight of caprolactam. The dispersion agent is applied so that it can be 40 cc per 1 kg of titanium dioxide particles. The thusly produced polyamide 6 polymer is spun in a typical spin-direct-draw condition, to thus produce a polyamide 6 yarn having 70 deniers and 36 filaments. The result of evaluating the physical properties of the produced yarn and operationability is as shown in Table 2.

EXAMPLES 2 TO 7 AND COMPARATIVE EXAMPLES 1 AND 2

Except that the quantity of titanium dioxide particles, the input of a dispersion agent and the input of a wetting agent are changed as in Table 1, a polyamide 6 polymer and yarn are produced in the same process and condition as Example 1. The result of evaluating the physical properties of the produced yarn and operationability is as shown in Table 2.

TABLE 1

| | Production Condition | | |
|---|---|---|---|
| Classification | Input of titanium dioxide relative to 100 parts by weight of caprolactam (parts by weight) | Input of dispersion agent per 1 kg of titanium dioxide particles (cc) | Input of wetting agent relative to weight of titanium dioxide (% by weight) |
| Example 1 | 1.8 | 40 | 0.3 |
| Example 2 | 1.6 | 40 | 0.3 |
| Example 3 | 2.4 | 40 | 0.3 |
| Example 4 | 1.8 | 35 | 0.3 |
| Example 5 | 1.8 | 60 | 0.3 |
| Example 6 | 1.8 | 40 | 0.1 |
| Example 7 | 1.8 | 40 | 0.5 |
| Comparative Example 1 | 1.3 | 0 | 0 |
| Comparative Example 2 | 2.6 | 0 | 0 |

TABLE 2

Result of Evaluation of Physical Properties

| Classification | Operationability (F/D rate) [%] | Number of condensed particles (개) | Content of titanium dioxide (% by weight) | Dispersability of titanium dioxide | Full dull property | Drape property |
|---|---|---|---|---|---|---|
| Example 1 | 98.1 | 64 | 1.8 | ◎ | ◎ | ◎ |
| Example 2 | 98.3 | 47 | 1.6 | ◎ | ◎ | ◎ |
| Example 3 | 96.2 | 94 | 2.4 | ◎ | ◎ | ◎ |
| Example 4 | 97.0 | 77 | 1.8 | ◎ | ◎ | ◎ |
| Example 5 | 98.3 | 57 | 1.8 | ◎ | ◎ | ◎ |
| Example 6 | 97.3 | 83 | 1.8 | ◎ | ◎ | ◎ |
| Example 7 | 97.6 | 64 | 1.8 | ◎ | ◎ | ◎ |
| Comparative Example 1 | 98.5 | 33 | 1.3 | ◎ | Δ | Δ |
| Comparative Example 2 | 92.1 | 137 | 2.6 | Δ | ○ | Δ |

* The content of titanium dioxide is % by weight relative to the weight of yarn.

INDUSTRIAL APPLICABILITY

The present invention can prevent the degradation of operationability and yarn physical properties since a great quantity of titanium dioxide having a proper diameter are uniformly dispersed in a polyamide 6 yarn. In addition, the polyamide 6 yarn of this invention uniformly contains titanium dioxide with a proper diameter, thus it has no metallic brilliance and has an excellent drape property.

What is claimed is:

1. A full dull polyamide 6 yarn, which contains 1.5 to 2.5% by weight of titanium dioxide relative to the weight of the yarn, which has 35 to 95 titanium dioxide particles having a major axial length of greater than 5 μm contained in 50 mg of the yarn, and which contains 0.1 to 0.5% by weight of phosphate salt as a wetting agent, relative to the weight of titanium dioxide.

* * * * *